US006043459A

United States Patent [19]

Jakobi et al.

[11] Patent Number: 6,043,459

[45] Date of Patent: Mar. 28, 2000

[54] ELECTRICALLY HEATABLE GLOW PLUG WITH OXYGEN GETTER MATERIAL

[75] Inventors: Hansjoerg Jakobi, Stuttgart; Roland Klak, Ostfildern; Karl-Heinz Thiemann, Korb; Hans Delesky, Sachsenheim, all of Germany

[73] Assignee: DaimlerChrysler AG and Beru AG, Germany

[21] Appl. No.: 09/216,944

[22] Filed: Dec. 21, 1998

[30] Foreign Application Priority Data

Dec. 20, 1997 [DE] Germany ..... 197 56 988

[51] Int. Cl.[7] ..... F23Q 7/00

[52] U.S. Cl. ..... 219/270; 219/544; 219/548; 123/145 A; 338/238

[58] Field of Search ..... 219/270, 544, 219/548, 553; 123/145 A, 145 R; 361/264–266; 338/238–242; 29/614–617, 611

[56] References Cited

U.S. PATENT DOCUMENTS

| | | | |
|---|---|---|---|
| 1,530,228 | 3/1925 | Braun | 219/553 |
| 4,252,091 | 2/1981 | Steinke | 123/145 A |
| 4,280,046 | 7/1981 | Shimotori et al. | 219/544 |
| 4,294,867 | 10/1981 | Boaz | 427/96 |
| 4,437,440 | 3/1984 | Suzuki et al. . | |

FOREIGN PATENT DOCUMENTS

| | | |
|---|---|---|
| 353196 | 1/1990 | European Pat. Off. . |
| 0 450 185 B1 | 10/1991 | European Pat. Off. . |
| 450185 | 8/1993 | European Pat. Off. . |
| 0 648 978 A2 | 4/1995 | European Pat. Off. . |
| 648978 | 4/1995 | European Pat. Off. . |
| 2 027 805 | 2/1980 | United Kingdom . |

*Primary Examiner*—John A. Jeffery
*Attorney, Agent, or Firm*—Evenson, McKeown, Lenahan & Edwards, P.L.L.C.

[57] ABSTRACT

An electrically heatable glow plug for an internal combustion engine includes a corrosion-resistant metal jacket, a compressed powder filling contained therein, and an electrically conducting coil embedded in the filling. To increase the lifetime of the heating coil, a getter material for binding the oxygen contained in the compressed powder filling is provided. The getter material can be distributed in the form of electrically nonconducting particles in the compressed powder filling. The getter material can also be applied as a coating to the coil or to the inner surface of the metal jacket.

10 Claims, 3 Drawing Sheets

ELECTRICALLY HEATABLE GLOW PLUG WITH OXYGEN GETTER MATERIAL

BACKGROUND AND SUMMARY OF THE INVENTION

This application claims the priority of German Patent Application No. 197 56 988.9, filed Dec. 20, 1997, the disclosure of which is expressly incorporated by reference herein.

A glow plug is used in Diesel engines in the combustion chamber for preheating during cold starts or as a glow pencil in the intake manifold for preheating the intake air. The glow plug or glow pencil consists of a corrosion-free metal jacket, a heating and regulating coil, and an electrically insulating compressed powder filling. The heating and regulating coil consists of a ferritic steel in the heating area, to which a pure nickel wire is soldered as a regulating resistance.

The material of the heating coil is subject to thermal and chemical influences that can adversely affect the lifetime of the glow plug. At the least, these influences constitute important parameters for the service life of the glow plug. Intercrystalline corrosion can occur which is promoted by crystal growth and a tendency toward coarse grain formation in ferrite heating conductors. In addition, at high temperatures there can be corrosion at the free surface of the heating coil and hence reduction of the cross section of the heating wire can occur. This process is made possible by the presence of oxygen which has been absorbed on the particle surface of the powder filling from the air during the manufacture of the glow plug.

The goal of the present invention is to provide a glow plug that has a heating coil with a long lifetime. According to the present invention, during the operation of the glow plug, the residual oxygen is bound by an integrated oxygen getter. Further, an inert atmosphere is maintained in the pores and on the free pore surface of the filling. Any corrosion processes of the type described above are therefore suppressed or proceed extremely slowly at most. Glow plugs equipped according to the present invention therefore have a considerably longer lifetime than before.

Other objects, advantages and novel features of the present invention will become apparent from the following detailed description of the invention when considered in conjunction with the accompanying drawings.

DETAILED DESCRIPTION OF THE DRAWINGS

Figure 1:
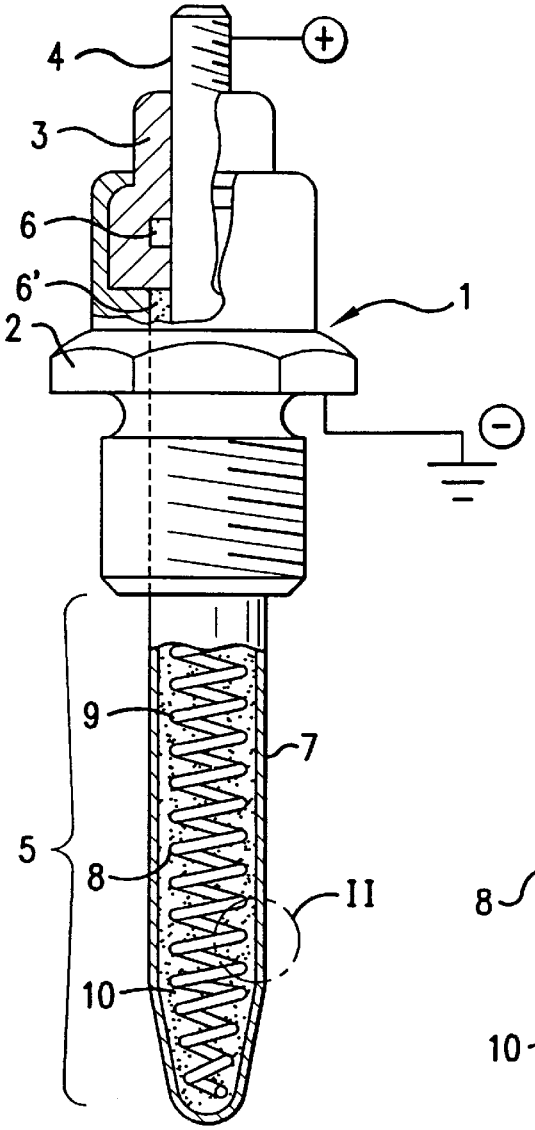
FIG. 1 shows a lengthwise section through a glow plug.

In Diesel engines, glow plugs are used in the combustion chamber for preheating during a cold start or, as rod-shaped flame glow plugs or a flame device in the intake manifold, for preheating the air. The embodiment shown in FIG. 1 of a glow plug 1 has a glow pencil 5 mounted in a base 2. The glow pencil consists of a corrosion-proof metal jacket 7, a heating coil 8 with a regulating coil 9 soldered thereto, and of an electrically insulating compressed powder filling 10, which ensures that heating and regulating coil 8, 9 can be mounted in a fixed location within metal jacket 7 and secured therein.

Metal jacket 7 usually consists of a nickel-rich iron alloy or a nickel-based alloy such as in INCONEL 601®, for example, and is connected electrically as a rule as a ground pole, in other words negatively.

The heating and regulating coil 8, 9 is soldered at one end in an electrically conducting fashion to the tip of metal jacket 7. The other end is connected with a terminal screw 4, also called the inner pole, embedded in an insulator 3. The screw is brought out of the base of the glow plug or glow pencil in an electrically insulated and sealed fashion (seal 6) and is connected with the positive (plus) pole of the power supply. In addition, the pin of inner pole 4 is sealed off at the upper open end of metal jacket 7 by a soft insulating seal 6' which must seal reliably. The heating and regulating coil 8,9 in the heating area (heating coil 8) consists of a ferritic steel, for example an iron-chromium-aluminum alloy with 17 to 22% chromium and 3 to 7% aluminum. An alloy that is frequently used is KANTAL AF CrAl1225®. A coiled wire (regulating coil 9) made of pure nickel is soldered to such a heating coil, and functions as a regulating resistor.

In general, magnesium oxide is used as powder filling 10. In order to minimize the atmospheric oxygen contained in the pores of the powder filling, the powder is very highly compressed, with the sealed metal jacket being formed externally by a constantly acting impact tool and as a result being reduced in diameter. The power filling is especially highly compressed in the area of the heating tip where the metal jacket is formed conically. Because of the high operating temperature of the heating coil and a sufficient oxygen supply in the compressed powder filling, creeping corrosion of the heating coil takes place. The residual oxygen is contained not only in the free pore volume of the powder filling filled with air, but it is adsorbed in particular on the very large pore surface of a filling made of magnesium powder.

According to the present invention, to increase the lifetime of heating coil 8, which is subjected to the very strong influence of thermal and chemical factors, a getter material that has a reducing effect when heated to operating temperature is contained inside metal jacket 7. The oxygen contained in compressed powder filling 10 is chemically bonded by this getter material and so an oxygen-free, in other words inert atmosphere, is created therein.

In selecting the getter material, it is important to note that during its chemical reaction with oxygen, no gases may be formed because the internal pressure in the glow plug or glow pencil would rise and the metal jacket could burst. Thus, carbon black and organic substances or hydrocarbons are ruled out as getter materials. For the same reason, namely avoiding the danger of bursting, carefully dried powder must also be loaded and compressed because otherwise a high steam pressure develops inside the heating rod during operation.

The following materials are favored as getter materials with a reducing effect:

- silicon, which can be oxidized to form SiO and then $SiO_2$;
- divalent iron oxide (FeO), which can oxidize to form trivalent iron oxide ($Fe_2O_3$);
- boron, which can oxidize to form $B_2O_3$; and
- titanium, which can oxidize to form trivalent and tetravalent oxide ($Ti_2O_3$ or $TiO_2$);
- aluminum which can oxidize to form trivalent $Al_2O_3$.

Figure 2:
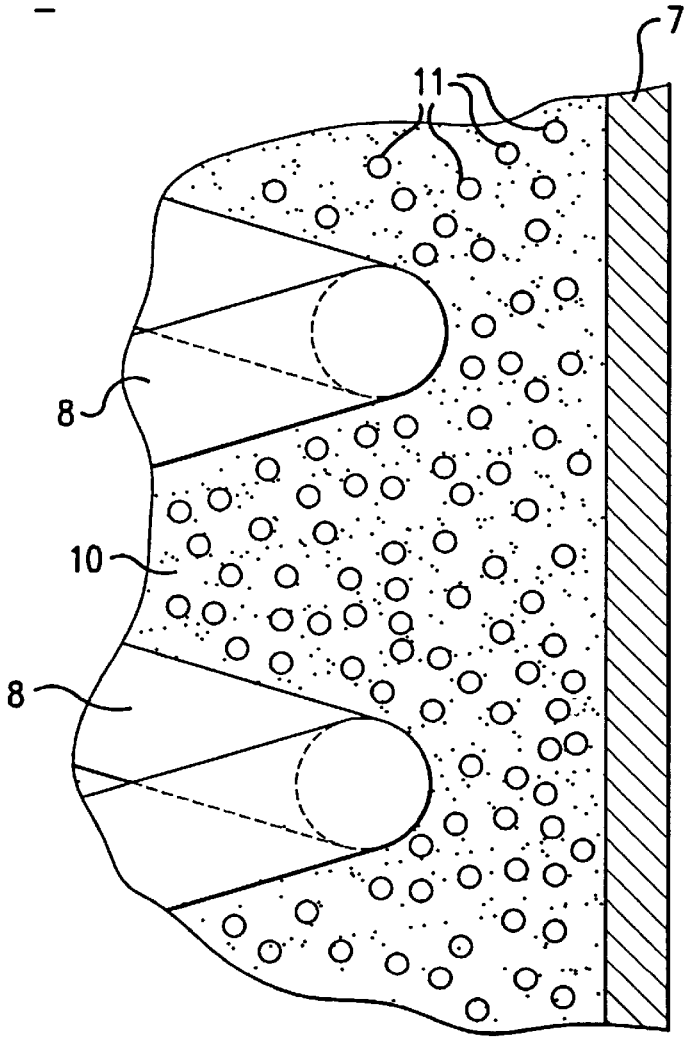
FIG. 2 shows an enlarged view of detail II in FIG. 1.

The getter material can be contained in the form of finely distributed particles 11 in compressed powder filling 10, as provided in the embodiment according to FIGS. 1 and 2. Since the powder filling is supposed to have an electrically insulating effect, particularly with a high admixture of getter material in the powder filling, the getter material particles 11 must likewise be electrically nonconducting.

Even though a small portion of the added getter particles can be of a metal nature, no metal bridges composed of the particles may form. For this reason, the getter material particles 11 mixed into the powder filling must consist at least predominantly of silicon or metal oxides. Indeed, in this case oxides of those metals that oxidize in several oxidation stages and which have a higher affinity for oxygen than the coil material can be used. In the initial state, the getter material is in the first oxidation stage when metal oxides are used. The basic materials that can be used include iron, boron, titanium, aluminum, vanadium, manganese, chromium, molybdenum, iridium, and/or tungsten, individually or in mixtures of various compositions. In addition, copper, tin, and/or cerium may be used.

Figure 3:
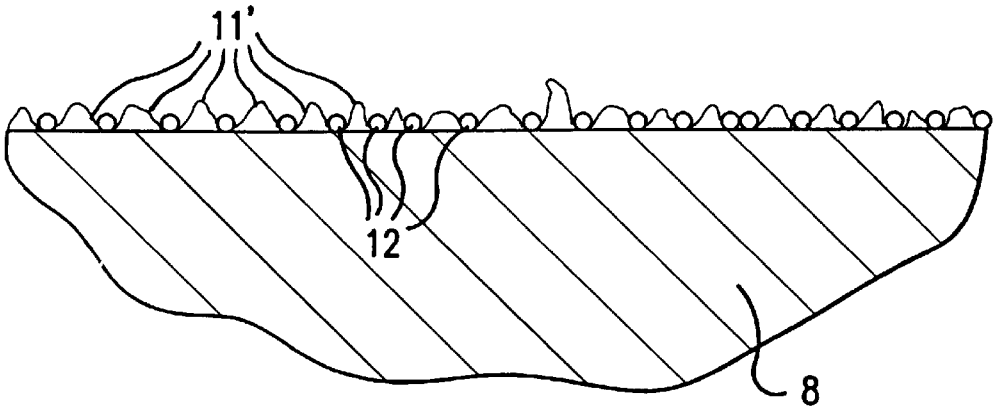
FIGS. 3 to 5 show various embodiments of coatings for the heating coil with getter material.
Figure 4:
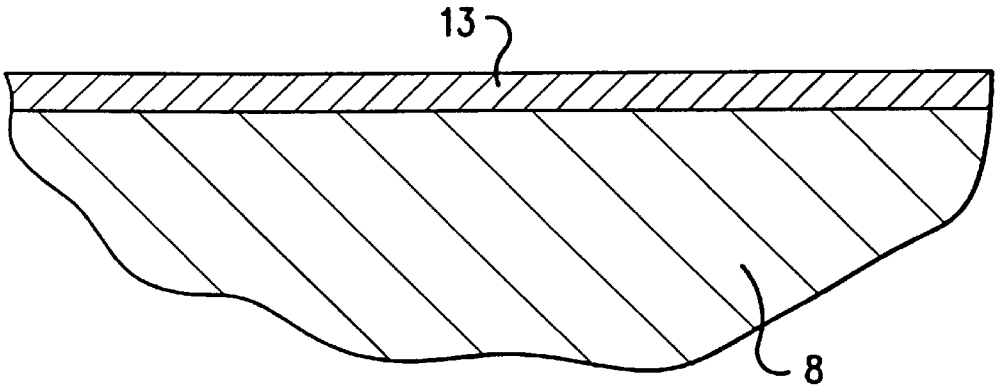
Figure 5:
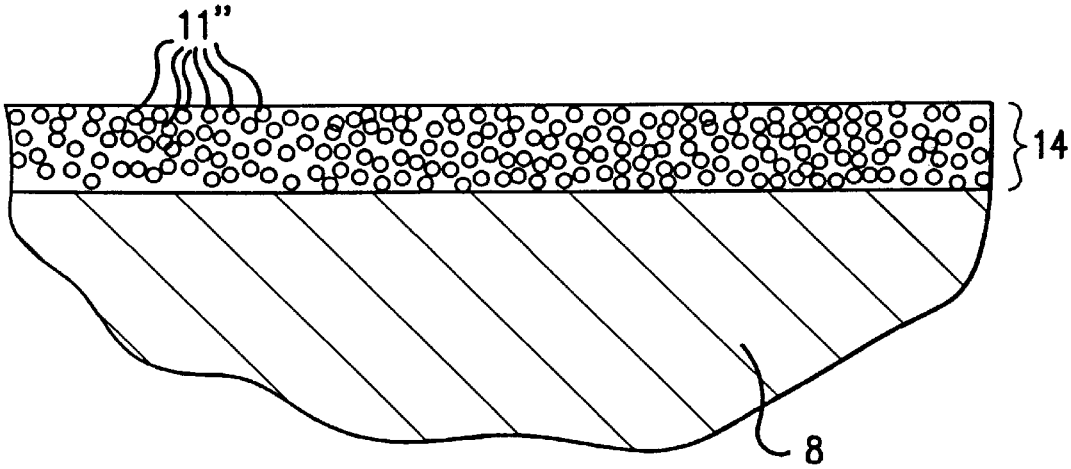
Figure 6:
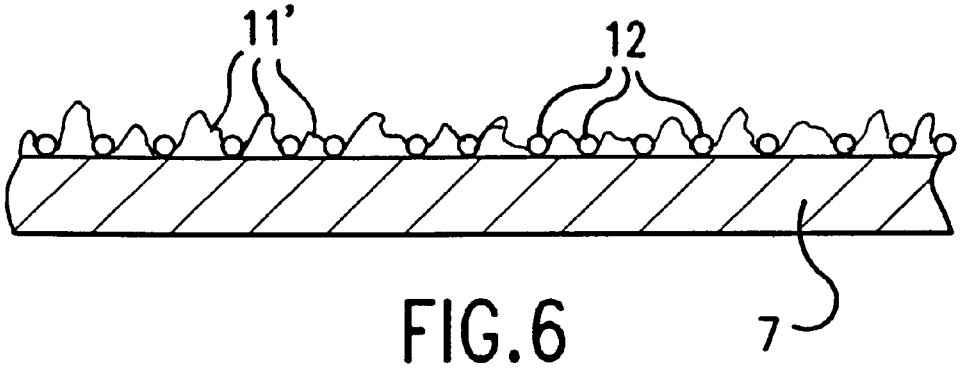
FIGS. 6 to 8 show various embodiments of coatings for the inner surface of the metal jacket with getter material.
Figure 7:
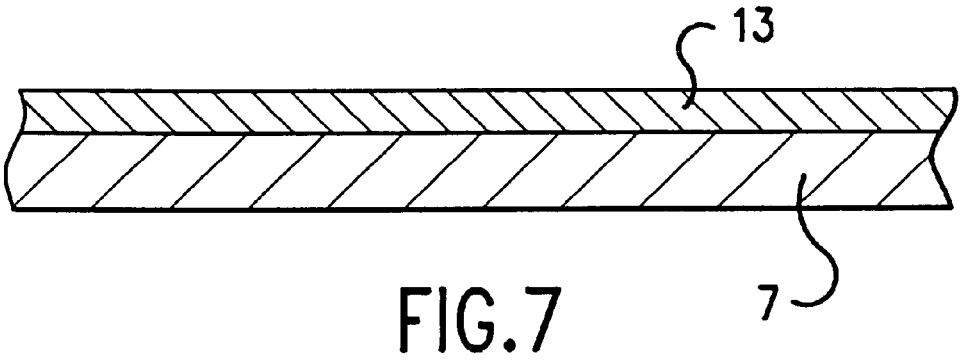
Figure 8:
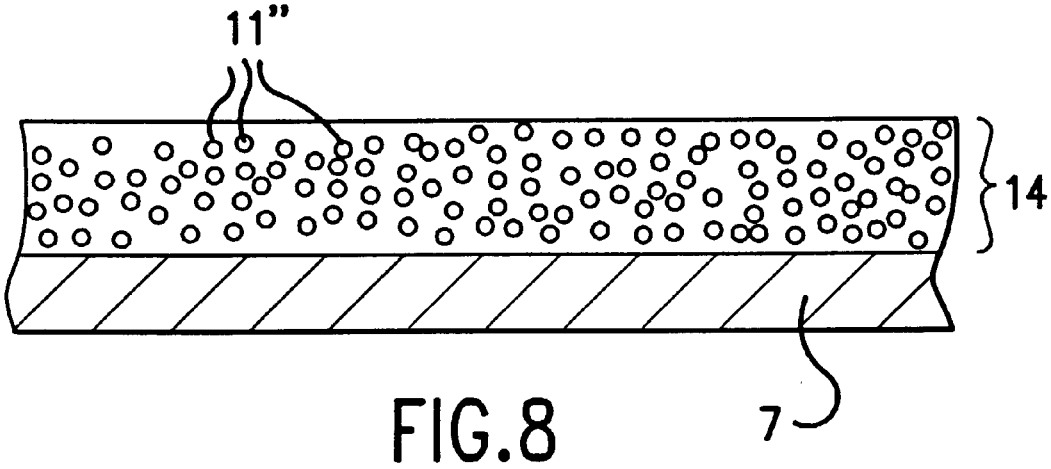

Instead of an admixture into the powder filling or even in addition thereto, the getter material according to the diagrams in FIGS. 3 to 5 can also be provided in the form of a coating on coil 8 or on the inner surface of metal jacket 7. The applied getter material coating can consist of a metal, namely of a metal or a mixture or alloy of metals that have a higher affinity for oxygen than the material of which the coil or jacket is composed and which also can alloy itself to only a slight degree if at all with the coil material or the jacket material. These include aluminum, tin, or lead. Aluminum can be dissolved only up to 5% in steel.

When metals are used as the oxygen-binding getter materials, the getter ability is especially high. For the sake of completeness, however, it should be mentioned that a coating on coil 8 or the inner surface of metal jacket 7 with getter material may also contain metal oxides with a low oxidation stages or consist completely of such metal oxides.

In the case of a coating on coil 8 or on the inner surface of metal jacket 7, the metal getter material can be applied galvanically, as indicated in FIG. 4 with a galvanic layer 13. Other types of coating are also possible. For example, the coil or the metal jacket can be provided with a coating of adhesive 12 by dipping or spraying, and metal particles 11' can then be embedded in this adhesive layer (FIG. 3), which can be done by dipping in loose powder or by spraying with powder. The adhesive layer can consist of organic binders such as polyhydric alcohols, bone glue, or wallpaper paste for example. The objects to be coated with getter material (coil 8, metal jacket 7) can also be coated with an organic adhesive layer 14 by dipping, wave coating, or spraying with an organic adhesive layer 14, in which getter particles 11" are embedded (see FIG. 5). However, before the assembly of the glow pencil, the organic binder must be eliminated by heat treatment of the coated parts at temperatures in a range from 400 to 600° C. Another coating method consists in electrostatic coating, in which the electrically charged getter particles are deposited on the objects to be coated, which are connected electrically at opposite potential. Other coating methods that may be used include plasma Dr pulsed-plasma coating as well as plasma vapor deposition, PVD, and chemical vapor deposition, CVD, methods.

By the addition according to the present invention of getter materials that have a reducing action into the interior of the glow pencil, the residual oxygen that is still present is bonded chemically. Of course, this goal can be achieved especially completely if an inert atmosphere is created in the powder filling in advance by adding an inert gas (for example, nitrogen, carbon dioxide) or a noble gas (for example, argon). The inert gas (contained in the powder filling is advantageously added to the reservoir for the filling powder which is required during the manufacturing process of the glow plugs and the powder is stored under inert gas so that the particles on its surface adsorb this gas and accumulate as little oxygen as possible on the surface. In addition, by filling the metal jacket with powder pneumatically, the inert gas can also be used as the carrier gas and the inert gas supply can be maintained while the powder is being shaken in. As a result, a certain loss of fine material in the vicinity of the still unwelded tip can be compensated by supplying fine material from the rear area. It is important that the inert gas and the powder filling be absolutely dry, which can be achieved for example by temporary heating of the filled metal jacket under an inert gas atmosphere and with removal of moisture.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electrically heatable glow plug for an internal combustion engine, comprising:

a corrosion-resistant sealed metal jacket comprising:

a filling of an electrically nonconducting compressed powder;

an electrically conducting coil embedded in the filling; and particles of an electrically nonconducting getter material for binding oxygen contained in the compressed powder filling, wherein said particles of getter material are uniformly distributed throughout the compressed powder; and at least one electrical terminal introduced into the metal jacket for the coil, wherein the metal jacket and the at least one terminal are sealed gas-tight.

2. A glow plug according to claim 1, wherein the getter material particles comprise elemental silicon.

3. A glow plug according to claim 1, wherein the getter material particles comprise at least one metal oxide that oxidizes in several oxidation stages and has a higher affinity for oxygen than the conducting coil has for oxygen, and wherein the getter material in the initial state comprise at least one metal oxide at the first oxidation stage.

4. A glow plug according to claim 3, wherein the at least one metal oxide contains a metal selected from the group consisting of iron, boron, titanium, vanadium, manganese, chromium, molybdenum, iridium, and tungsten at the first oxidation stage.

5. A glow plug according to claim 3, wherein the getter material particles further comprises at least one oxide of copper, tin, and cerium at the first oxidation stage.

6. A glow plug according to claim 1, wherein the metal jacket further contains an inert gas, a noble gas, or a mixture thereof, thereby minimizing any residual oxygen.

7. A glow plug according to claim 6, wherein the inert gas is nitrogen or carbon dioxide.

8. A glow plug according to claim 6, wherein the noble gas is argon.

9. A glow plug according to claim 1, wherein the conducting coil comprises a heating coil and a regulating coil.

10. An electrically heatable glow plug for an internal combustion engine, comprising:

a corrosion-resistant sealed metal jacket comprising:

a filling of an electrically nonconducting compressed powder;

an electrically conducting coil embedded in the filling; and particles of an electrically nonconducting getter material for binding oxygen contained in the compressed powder filling, wherein said particles of getter material are uniformly distributed throughout the compressed powder; and at least one electrical terminal introduced into the metal jacket for the coil, wherein the metal jacket and the at least one terminal are sealed gas-tight, wherein the getter material particles comprise silicon or at least one mental oxide that oxidizes in several oxidation stages and has a higher affinity for oxygen than the conducting coil has for oxygen, and wherein the getter material in the initial state comprises at least one metal oxide at the first oxidation stage.

* * * * *